United States Patent [19]

Lehto et al.

[11] Patent Number: 4,632,778

[45] Date of Patent: Dec. 30, 1986

[54] PROCEDURE FOR CERAMIZING RADIOACTIVE WASTES

[75] Inventors: Jukka K. Lehto; Jorma K. Miettinen; Olli Heinonen, all of Helsinki, Finland

[73] Assignee: Imatran Voima Oy, Finland

[21] Appl. No.: 574,152

[22] PCT Filed: Apr. 26, 1983

[86] PCT No.: PCT/FI83/00037

§ 371 Date: Dec. 20, 1983

§ 102(e) Date: Dec. 20, 1983

[87] PCT Pub. No.: WO83/03919

PCT Pub. Date: Nov. 10, 1983

[30] Foreign Application Priority Data

Apr. 30, 1982 [FI] Finland ..... 821536

[51] Int. Cl.[4] ..... G21F 9/28; G21F 9/12; G21F 9/16

[52] U.S. Cl. ..... 252/629; 252/628; 252/631; 252/633

[58] Field of Search ..... 252/629, 628, 631, 633; 501/11, 18, 134, 141

[56] References Cited

U.S. PATENT DOCUMENTS

| | | | |
|---|---|---|---|
| 2,616,847 | 4/1951 | Ginell | 252/629 |
| 3,093,593 | 6/1963 | Arrance | 252/629 |
| 3,249,551 | 5/1966 | Bixby | 252/629 |
| 4,297,304 | 10/1981 | Scheffler et al. | 252/629 |

FOREIGN PATENT DOCUMENTS

| | | | |
|---|---|---|---|
| 1588350 | 4/1981 | United Kingdom | 252/629 |

*Primary Examiner*—John F. Terapane
*Assistant Examiner*—Virginia Caress
*Attorney, Agent, or Firm*—Steinberg & Raskin

[57] ABSTRACT

The present invention concerns a procedure for transforming radioactive wastes into ceramics. From the radioactive waste solution, the waste is bound to an inorganic ion exchanger either with batch equilibration or in columns. After the waste has been bound to the ion exchanger, it is transformed into ceramics by admixing it to tile clay or to another ceramizing material and by firing the mixture to a tile. This yields an extremely low soluble and mechanically durable ultimate disposal product of the nuclear waste. The ceramizing procedure is applicable with any inorganic ion exchanger.

6 Claims, 2 Drawing Figures

PROCEDURE FOR CERAMIZING RADIOACTIVE WASTES

BACKGROUND OF THE INVENTION

The present invention concerns a procedure for transforming radioactive wastes into ceramics.

Treatment of the radioactive waste solutions accruing in nuclear energy production aims at transforming the wastes into a safe form for ultimate disposal. In this context, safety implies low solubility of the final waste product, and good mechanical as well as thermal and radiation stability.

In solidifying low and medium-active power plant wastes, the commonest procedures are embedding in concrete and in bitumen. The greatest drawback of the inexpensive and simple embedding in concrete is the high leach rate of radio nuclides from the solidified product. Bituminized products have a lower degree of solubility, but the process is a lot more difficult and risky, e.g., because of risk of ignition. The only procedure widely used in solidifying the high-active waste from reprocessing of spent fuel is vitrifying the waste, particularly in borosilicate glasses. However, experiments carried out with ceramic final waste products such as titanate, zirconate and niobate-based ceramic transformation products have proved that these are superior to glass products in stability, and are gaining ground in research.

Titanates, in particular sodium titanate, are the most important base materials for ceramic products for ultimate disposal. The radioactive wastes are bound to them in the material synthesis, by ion exchange or by mechanical mixing in calcinate form. Thereafter, the product may be transformed into ceramics under high pressure and at high temperature. The most promising ceramic final waste product is SYNROC (A. E. Ringwood et. al., Immobilization of High Level Nuclear Reactor Wastes in Synroc: A Current Appraisal, Research School of Earth Sciences, Australia National University, Publication No. 1975, 1981). It is composed of three minerals, the main components of which are $TiO_2$ (60%) and $ZrO_2$ (10%). These minerals are analogous to minerals occurring in nature, and they have been found to have exceedingly low solubility and to tolerate radiation extremely well.

The drawback encumbering the ceramizing procedures studied so far is their complexity and high cost. Expensive initial materials awkward to pre-treat and expensive compressing apparatus are used in them.

SUMMARY OF THE INVENTION

The present invention aims at improvement of the procedures known in the art. A more specific aim of the invention is to provide a procedure which is simple in its process technology, and economical, and wherein inexpensive and readily available initial materials are used, for instance conventional raw materials of the ceramic industry. The invention is applicable in connection with both low- and high-active wastes. The other objects of the invention and the advantages gainable with its aid will become apparent in the disclosure of the invention.

The aims of the invention are achieved by means of a procedure which is mainly characterized in that the procedure comprises the following steps:

(a) from the radioactive waste solution, the waste is bound to an inorganic ion exchanger, (b) the inorganic ion exchangers loaded with wastes are admixed to a ceramizing substance, and (c) the waste mixed with ceramizing substance is baked to become the final waste product.

By means of the procedure of the invention, a number of remarkable advantages are achieved. The invention describes a ceramizing procedure for inorganic ionic exchangers based on inexpensive and readily available initial materials, on conventional raw-materials of the ceramic industry and on a simple process technology, appropriate for both low- and high-active wastes. The raw materials for bricks and tiles are cheap and readily and continuously available. The manufacturing technology of tiles is simple, and the firing temperature of tiles is relatively low, thus preventing evaporation of certain radioactive substances during the baking process. It is possible to add to the tiles synthetic or natural additives, such as vermiculite or apatite, which improve the stability of certain substances in the tiles. In tile firing, no complex pressing apparatus is required, and this greatly reduces the cost and simplifies the process. Clay tile containing titanate is glazed in the course of firing and becomes very low soluble. It can be coated with an inactive surface layer. Thereby no metal container is needed for tiles loaded with medium-active wastes. Compared with bituminized and concreted products, by means of the procedure of the invention a remarkable saving in volume is achieved, and the ultimate decrease in volume is of the same order of magnitude as with vitrified products.

BRIEF DESCRIPTION OF THE DRAWINGS

The possible ways of applying the invention are described in detail in the drawings attached. In them are presented the most important modes of applying the invention, but to which the invention is not meant to be exclusively confined.

DETAILED DESCRIPTION OF THE PREFERRED EMBODIMENTS

Figure 1:
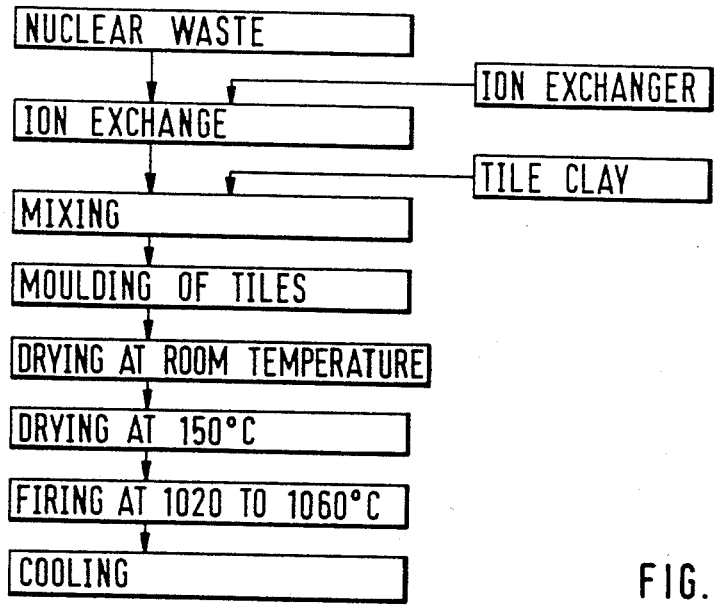
FIG. 1 presents the procedure of the invention in the form of a process chart in a case in which batch equilibrating is used.
Figure 2:
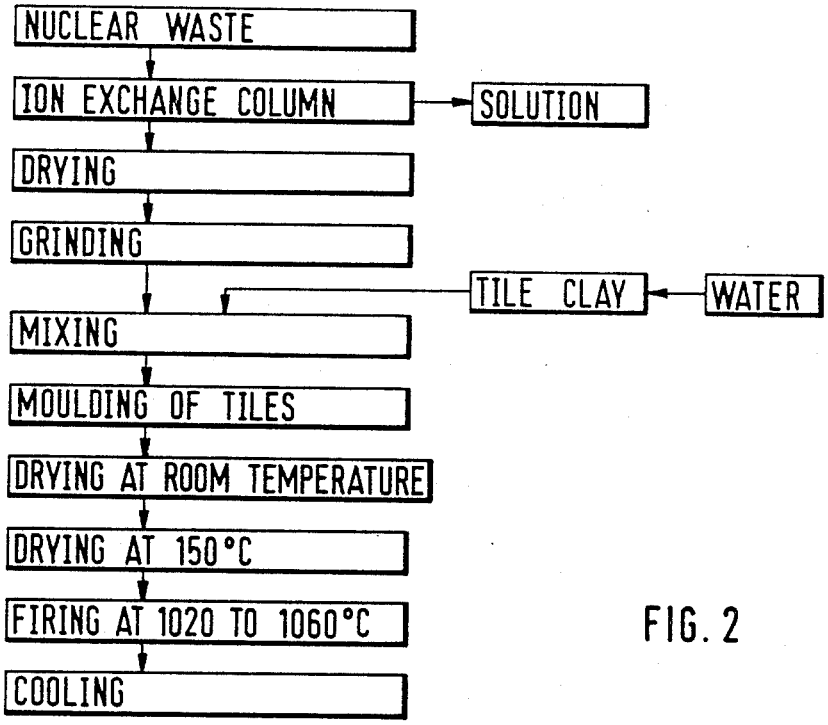
FIG. 2 presents the procedure of the invention in the form of a process chart in a case in which the waste is bound in an ion exchange column.

In the procedure of the invention, the radioactive wastes in solution form are bound to an inorganic ion exchanger, such as titanate, niobate, zirconate or zirconium dioxide. For better binding in the tiles of certain radionuclides such as Cs, one may add synthetic or natural additives, such as vermiculite, laumontite or apatite to the tiles. In case batch equilibrating is used, the ion exchanger need not be dried and ground, and the tile clay may be added to the waste ion exchanger mixture directly after equilibrating so that the water content of the mixture will be about 23 to 27%. The mass ratio of ion exchanger to tile clay is 1/9 to 2/8.

The materials used to serve as ceramizing substances include red clay, kaolin, montmorillonite, feldspar, illite and quartz.

After mixing the tile clay, the mixture is stirred with care so as to make it bakable. Hereafter, it is shaped into tiles in a mould. The tiles may be pressed to make them less porous. The tiles are left to dry overnight. Thereafter, they are dried at about 150° C. for at least four hours and allowed to cool over night.

The firing of the tiles is accomplished as follows. The kiln is heated at a rate of approximately 100° C. per hour up to 1020°-1060° C. The tiles are kept at peak temperature for 4-10 hours. After the firing, the tiles are allowed to cool in the kiln.

The tile kiln may be lined with thin inactive tiles in order to bind volatile substances. These lining tiles are replaced from time to time and disposed of along with the waste tiles. The tile firing may also be made continuous, applying experience gained in the ceramic industry.

The quality factor of the tiles most important in view of the ultimate disposal is solubility from them of the waste nuclides. The leach rates of Sr, Cs and Co from sodium titanate or $ZrO_2$/red clay tiles loaded with evaporator waste concentrate are $10^{-6}$ to $10^{-7}$ g per $cm^2$ x d in the declining order mentioned above. The solubility of Sr from sodium titanate/red clay tiles loaded with high-active waste is higher by one order of magnitude. Addition of vermiculite (2%) to the tiles causes some decrease of solubility. Thus, the leach rates are of the order of those of the best borosilicate glasses.

The solubility properties of the tiles may be improved either by glazing their surface or by baking an inactive layer upon the surface of the tile of the tile clay that is being used. Even adding titanate to the tile clays will cause glazing of the tiles, and titanate/red clay tiles are rather less porous than the plain red clay tiles. The tile would be ideal when its solubility properties would allow it to be ultimately disposed without any extra shells. This may be contemplated at least in the case of tiles loaded with medium-active wastes.

The tiles present very high mechanical durability, a feature important with a view to handling and transporting. The tiles have flexural strengths on the order of 20-30 $MN/m^2$ (meganewtons per square meter).

When the amount of ion exchangers in the tiles is 15% at the most, the evaporation of metals therefrom is minimal: at the most, something like 2% when the firing temperature is 1020° C. With increasing amount of ion exchanger, and with temperature higher than mentioned, higher evaporation is also incurred. The optimum values for minimum evaporation are: 15% ion exchanger loading in the tile, firing temperature 1020° C., and firing time 4 hours.

The procedure of the invention can be used for transforming into ceramics at least the most important wastes, such as evaporation waste concentrates, waste nuclides eluted from spent reactor resins, and high-active reprocessing waste.

Various details of the invention may vary within the scope of the inventive idea described above.

I claim:

1. Method of transforming radioactive waste into ceramic, which comprises the steps of first mixing a waste from radioactive waste solution with an inorganic ion exchanger selected from the group consisting of titanates, niobates, zirconates, and zirconium dioxides, and mixtures thereof, after said first mixing is completed, mixing the resulting inorganic ion exchanger loaded with the waste with a ceramizing material selected from the group consisting of red clay, kaolin, montmorillonite, feldspar, illite, and quartz, and mixtures thereof, adding water to the thus-formed mixture, to form a further mixture thereof, forming shaped tiles of the thus-formed further mixture, drying said tiles, and firing the thus-dried, shaped tiles in a kiln, without pressing of the same, at a temperature at which ceramic formation takes place, whereby shaped, ceramic tiles of radioactive waste are formed for subsequent disposal.

2. The method of claim 1, wherein the shaped bodies are dried overnight.

3. The method of claim 2, wherein the drying of said shaped bodies is at a temperature of about 150° C. for at least four hours after drying overnight.

4. The method of claim 1, wherein the temperature of firing in said kiln is at a temperature of about 1020°-1060° C. for about four to ten hours.

5. The method of claim 4, comprising the additional step of raising the temperature of the kiln at a rate of about 100° C. per hour.

6. The method according to claim 4, comprising the additional step of cooling the thus-shaped ceramic bodies within the kiln, at the cooling rate of the kiln.

* * * * *